United States Patent [19]

Bukovitz et al.

[11] 3,992,831

[45] Nov. 23, 1976

[54] ANGLE DRILLING APPARATUS

[75] Inventors: Ronald Francis Bukovitz; Ernst Lennart Lindstedt, both of Clarksburg, W. Va.

[73] Assignee: Ingersoll-Rand Company, Woodcliff Lake, N.J.

[22] Filed: Feb. 18, 1976

[21] Appl. No.: 658,878

[52] U.S. Cl. ..... 52/116; 52/117; 173/43; 212/46 R

[51] Int. Cl.[2] ..... E04H 12/34

[58] Field of Search ..... 52/116, 117, 118, 119; 173/43; 212/46; 182/127, 68

[56] References Cited

UNITED STATES PATENTS

| | | | |
|---|---|---|---|
| 2,193,293 | 3/1940 | Nichols | 173/28 X |
| 2,689,549 | 9/1954 | Hayman | 52/117 X |
| 2,711,803 | 6/1955 | Hurst | 52/119 X |
| 2,790,622 | 4/1957 | Priest | 52/119 X |
| 3,032,147 | 5/1962 | Wilkinson et al. | 52/118 |
| 3,245,180 | 4/1966 | Bules et al. | 52/116 |
| 3,778,940 | 12/1973 | Blecken | 52/116 |
| 3,783,953 | 1/1974 | Kopaska | 173/43 X |
| 3,815,690 | 6/1974 | Cooper | 173/28 |

*Primary Examiner*—Price C. Faw, Jr.
*Assistant Examiner*—Leslie Braun
*Attorney, Agent, or Firm*—F. S. Troidl

[57] ABSTRACT

Two pivots are provided on a drill tower support. The drill tower is supported on and positively locked to the upper pivot in the horizontal position.

The drill tower can be pivoted about the first pivot from the horizontal position to the vertical position and positively locked to the lower pivot. The drill tower is then disconnected from the first pivot and thereafter it can be pivoted about the second pivot for angle drilling.

3 Claims, 9 Drawing Figures

ANGLE DRILLING APPARATUS

This invention relates to drilling apparatus. More particularly, this invention is a new and improved angle drilling apparatus utilizing new and improved structure for positively locking the drill tower in one of two alternate pivot points.

It is known to mount a drill tower on a vehicle so that the tower can be moved from one drilling location to another in a horizontal, vertical or angled position. It is also known to provide two pivot points spaced along the length of the tower and alternately engagable during the swinging of the tower between the horizontal and vertical positions. One example is shown in U.S. Pat. No. 3,778,940 issued Dec. 18, 1973 to William E. Blecken and entitled "Transferential Pin".

The present invention is a new and novel structure for positively locking the drill tower to the support while the tower is in the horizontal position and while the tower is being pivoted about one pivot point from the horizontal to the vertical position and new and novel structure for locking the drill to the second pivot while permitting the angular movement of the drill tower about said second pivot for angle drilling.

Briefly described, the invention includes a platform with support means extending upwardly from the platform. A part of the drill tower is mounted for pivotal movement about an upper pivot on the support means. The upper pivot includes a slot in the drill tower support means with the previously mentioned part of the drill tower adaped to fit into the slot for pivotal connection of the drilling tower to the drill tower support. The upper pivot also includes means for positively locking the drill tower into the slot when the drill tower is horizontal. The upper pivot support means with its positive locking feature also permits the locked in part of the drill tower to move the drill tower support means when the drill tower is pivoted to the vertical position. A second pivot means is included which has slotted means mounted on the platform and a second part of the drill tower is adapted to fit into the slotted means. Means are also provided for positively locking the second part of the drill tower to the platform. Thus, the drill tower may be pivoted from the horizontal position to the vertical position, positively locked to the second pivot means, and disconnected from the first pivot means. The drill tower may thereafter be pivoted about the second pivot means for angle drilling.

The invention as well as its many advantages may be further understood by refernce to the following detailed description and drawings in which.

In the various figures, like parts are referred to by like numbers.

Figure 1:
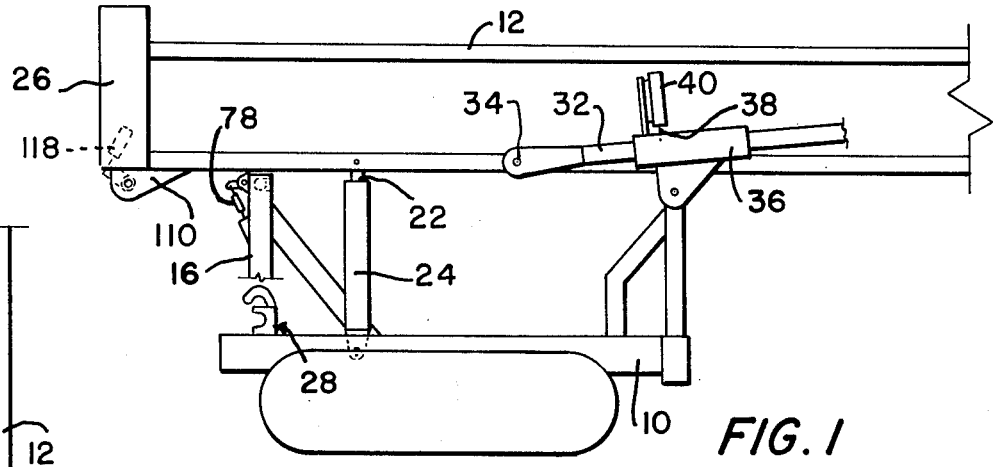
FIG. 1 is a schematic view showing a drill tower mounted on a mobile platform in the horizontal position.

Referring to the drawings, and more particularly to FIG. 1, a mobile platform 10 supports a drill tower 12. A pair of laterally spaced and connected supports 14 and 16 (see FIG. 1 and FIG. 5) extend upwardly from the platform 10. When the drill tower 12 is in the horizontal position, the drill tower is pivotally connected to the upper portion of supports 14 and 16.

Figure 2:
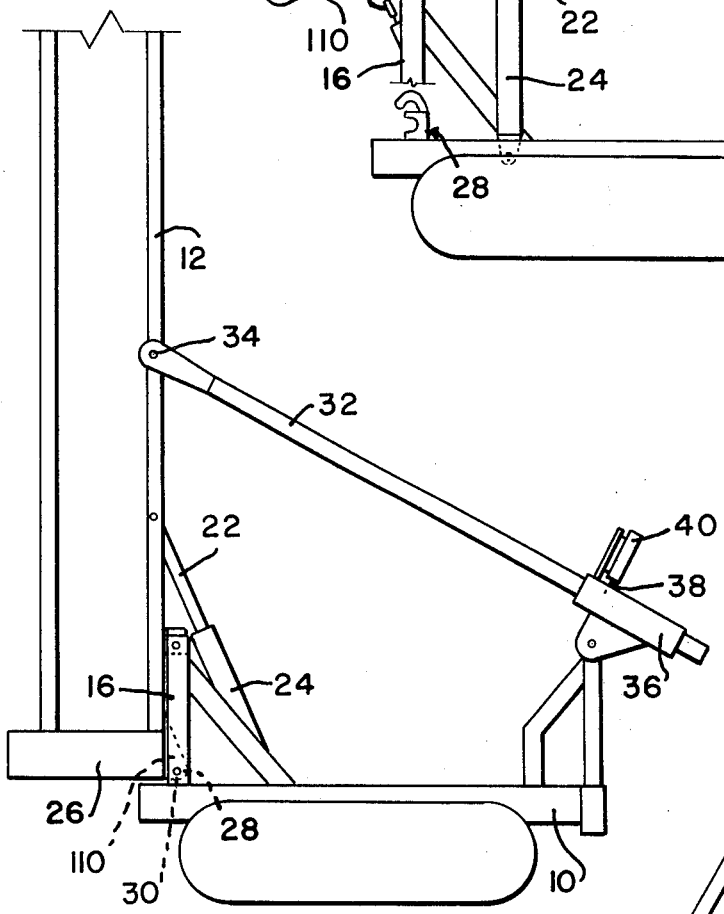
FIG. 2 is a schematic view showing the drill tower in its vertical position.

To pivot the drill tower 12 from the horizontal position to the vertical position shown in FIG. 2, a hydraulically actuated rod 22 actuated by hydraulic fluid in hydraulic cylinder 24 pivots drill tower 12 about the upper pivots. When the drill tower 12 is pivoted to the vertical position, a part of the drill tower 12 adjacent the drill tower platform 26 engages the lower pivot members 28 and 30 (see FIG. 1 and FIG. 6). While the drill tower 12 is pivoted about the upper pivots from the horizontal position to the vertical position, the drill tower is kept positively locked to thereby prevent any possibility of the drill tower falling out of the pivots, until after the drill tower 12 is positively locked into the lower pivot means 28 and 30, in the vertical position.

Figure 3:
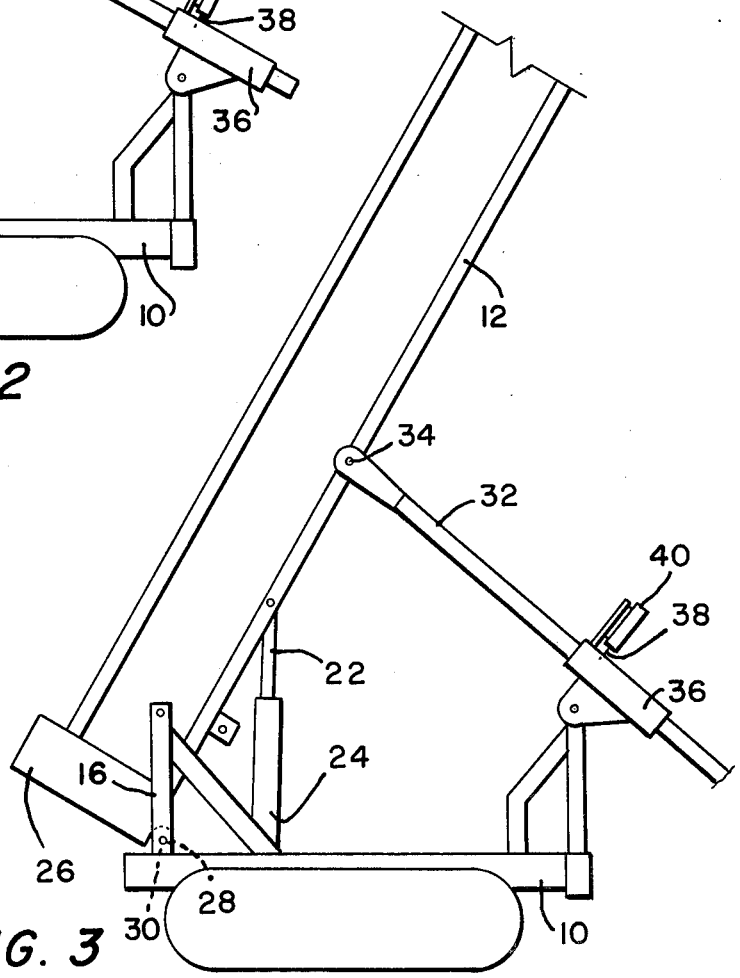
FIG. 3 is a schematic view showing the drill tower at an angle for angle drilling.

As shown in FIG. 3, the drill tower 12 after it has been securely and positively locked in the lower pivots 28 and 30, may be pivoted about said pivots for angle drilling. The actual angle the drill is from the vertical, is determined by a pair of arms 32 (only one shown). Each arm 32 has its outer end connected to the drill tower 12 at 34, and the arm 32 extends through an arm support 36. A pneumatic rod 38 operated by air in a pneumatic cylinder 40 extends through the arm support 36 and into one of a plurality of longitudinally spaced holes (not shown) in the arm 32.

The particular angle of the drill tower 12 with respect to the vertical is set by actuating rod 22 by means of hydraulic cylinder 24 to pivot the drill tower 12 about pivots 28 and 30. While this is done the pneumatic rod 38 is in the retracted position so that the shaft 32 will move longitudinally within the shaft support 36. When a predetermined hole in shaft 32 is in position, the pneumatic rod 38 is actuated to enter into the hole and lock the drill tower at the desired angle.

Figure 4:
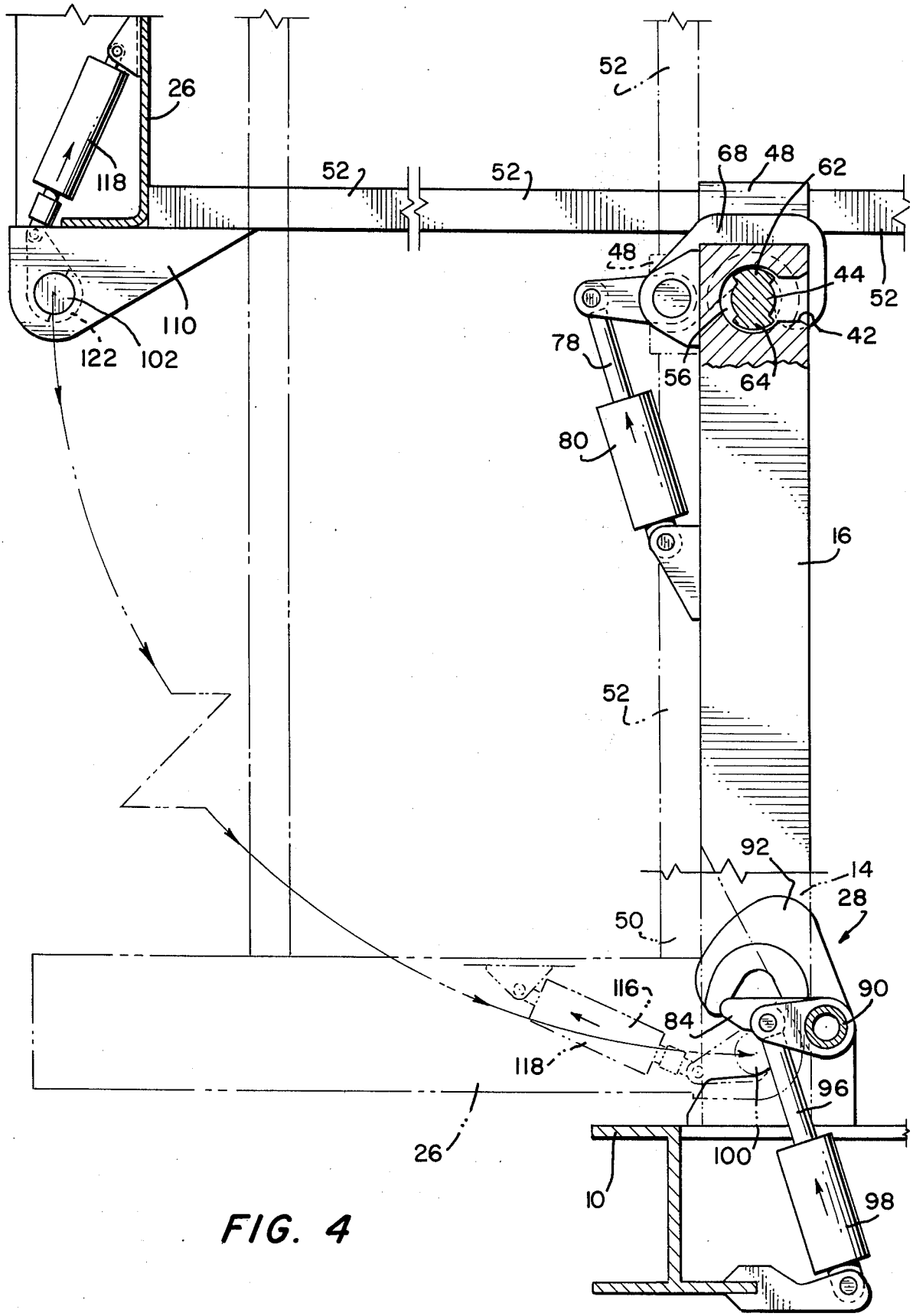
FIG. 4 is an enlarged fragmentary view, partly in section, showing the positive locking means for the upper pivot on the tower support and the positive locking means on the lower pivot of the tower support.
Figure 5:
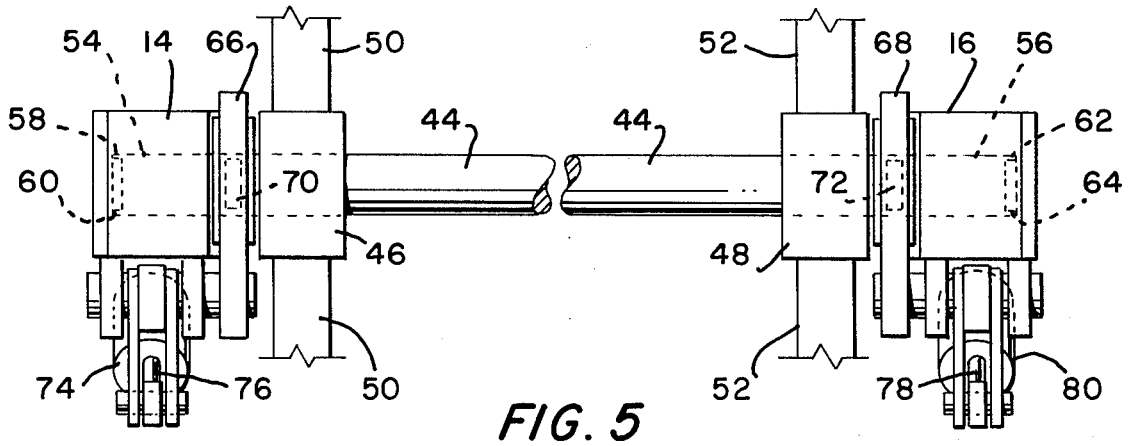
FIG. 5 is a top view of the upper pivot section.
Figure 7:
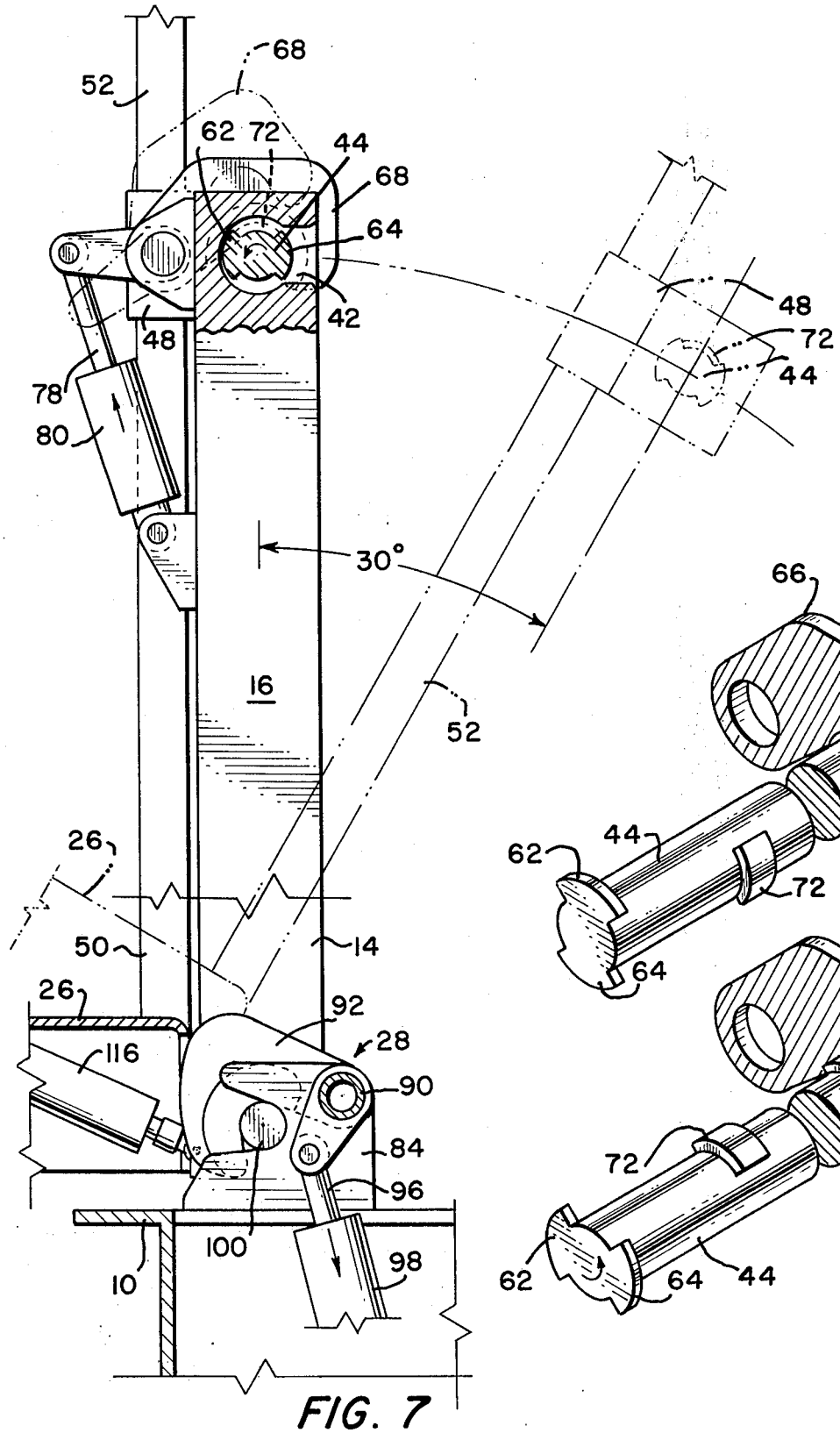
FIG. 7 is an enlarged fragmentary view, partly in section, showing the positions of the upper and lower positive locking means when the tower is in the vertical position.
Figure 8:
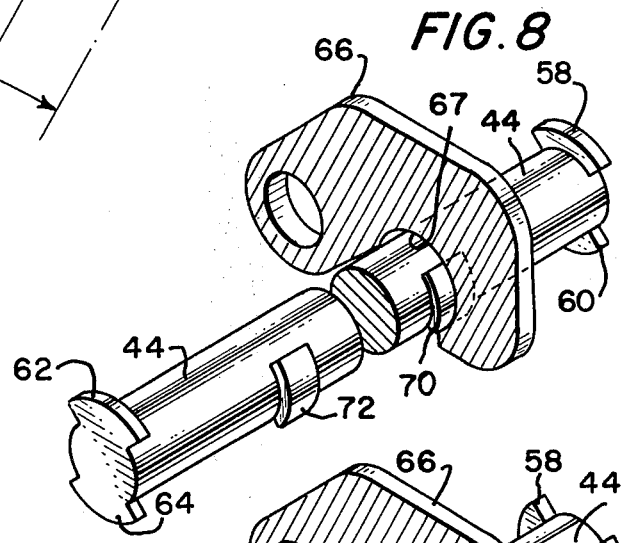
FIG. 8 is a perspective view illustrating the position of the positive locking means of the upper pivot in the tower positive locking position.

Referring to FIG. 4 and FIG. 5, the upper portion of each drill tower support 14 and 16 is provided with a rearwardly extending slot 42 (only the slot in support 16 being shown). A rotatable shaft 44 (see FIG. 5) is mounted within shaft supports 46 and 48, which in turn are connected to vertical struts 50 and 52, respectively, forming part of the tower 12. The outer ends of the shaft 44 are also supported in bores 54 and 56, located in supports 14 and 16, respectively. The rearwardly extending slots 42 extend from the bores 54 and 56 to the rear edge of the supports 14 and 16. A pair of diametrically spaced locking ears 58 and 60 are provided on the edge of the shaft 44 fitting in bore 54; a pair of diametrically opposite locking ears 62 and 64 (see FIGS. 5, 8 and 9) is provided on the other end of the shaft 44 fitting into the bore 56. In FIG. 7, the locking ears are shown in the same position as shown in FIG. 8. In FIG. 5, the locking ears are shown in the same position as shown in FIG. 9.

The diameter of shaft 44 is small enough so that the shaft will slide from the upper parts of supports 14 and 16 through the slots 42. However, the provision of the locking ears fitted into a counter bore make the effective diameter of the shaft 44 when the shaft 44 is rotated to the position shown in FIG. 4, such that the shaft 44 will not slide out of the bores 54 and 56, and the shaft 44 is positively locked within the bores 54 and 56.

In order to further make certain the shaft 44 is positively locked within the drill tower supports 14 and 16, a pair of hook assemblies 66 and 68 (see FIGS. 4, 8 and 9) are provided. The shaft 44 is provided with locking ears 70 and 72, which are longitudinally spaced from locking ears 58 and 60, and locking ears 62 and 64 and circumferentially located between said locking ears 58 and 60, and locking ears 62 and 64 and in a plane generally the same as the planes of the hooks 66 and 68, respectively.

Figure 9:
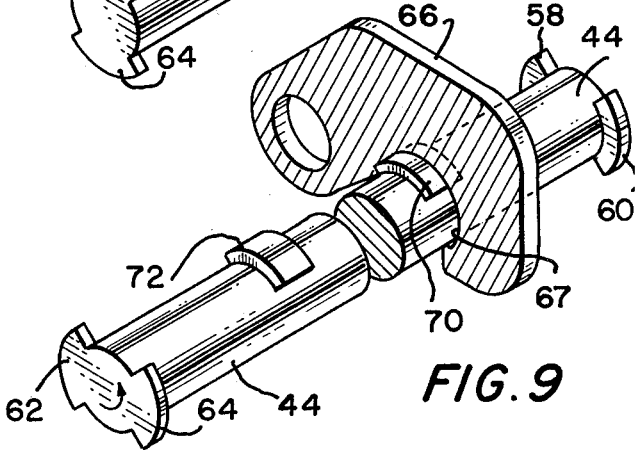
FIG. 9 is a perspective view similar to FIG. 8 showing the positive locking mechanism of the top pivot in position to permit the movement of the hooks and the movement of the drill tower out of the upper pivot support for angle drilling.

Each of the hooks 66 and 68 is provided with undercuts such as the undercut 67 shown on hook 68, more particularly in FIG. 8 and FIG. 9. The undercuts 67 on hook 68 as well as the undercut on hook 66 is of a predetermined diameter such that when the diameter across the locking ears 70 and 72 are in the position shown in FIG. 8, there forms an interference diametrical fit between the swing radius of the hook across the hook locking ears 70 and 72 and the undercuts in the hooks 66 and 68. With this interference fit, it is impossible for the hook to be removed from the shaft 44, either intentionally or accidentally.

However, when the shaft 44 is rotated in the counterclockwise direction, looking at FIG. 9, the hook locking ears 70 and 72 are rotated to a position such that there is no longer an interference diametrical fit between the hook locking ears 70 and 72 and the undercuts of hooks 66 and 68, respectively. Therefore, when the hook locking ears 70 and 72 are in the position shown in FIG. 9, the hooks 66 and 68 may be actuated to remove the hooks from the shaft 44. This is accomplished by a hydraulically operated assembly including hydraulic cylinder 74, (FIG. 4 and FIG. 5) which operates hydraulic rods 76, which in turn operates the hook 66 through a mechanical interconnection. Hook 68 is operated by means of a mechanical interconnection to the hydraulic rod 78 operated by hydraulic cylinder 80 (see FIG. 4 and FIG. 5).

When the drill tower is in the horizontal position, the shaft 44 with its locking ears and its hook locking ears is in the position shown in FIG. 4 and FIG. 8. Hooks 66 and 68 are also in the position shown in FIG. 4 and FIG. 8. The tower 12 is moved to the vertical position by the operation of cylinder 24 to move cylinder rod 22 upwardly (see FIG. 1) to thereby pivot the tower about the upper pivot means. As the tower 12 moves from the horizontal to the vertical, the shaft 44 is rotated in a counterclockwise direction looking at FIG. 4 and FIG. 7. When the tower 12 is fully vertical the shaft locking ears 58, 60, 62, and 64 and the hook locking ears 70 and 72 are in the positions shown in FIGS. 5, 7 and 9. The hook 68 is in the full line position of FIG. 7 and the hook 66 is in the position shown in FIG. 9. With these elements in the positions shown for the vertical position of the tower 12, the hooks 66 and 68 can then be actuated by their respective hydraulically actuated systems to the position shown in broken lines in FIG. 7 and the shaft 44 removed from the drill tower supports 14 and 16. Thus, the drill tower can be moved from the horizontal to the vertical and securely locked to the second pivot means 28 and 30 (see FIG. 1) while keeping the shaft positively locked in the upper pivots. Therefore, there is a guarantee that the drill tower is securely locked inth lower pivot means 28 and 30 before the drill tower is subsequently pivoted about the lower pivot means for angle drilling.

Figure 6:
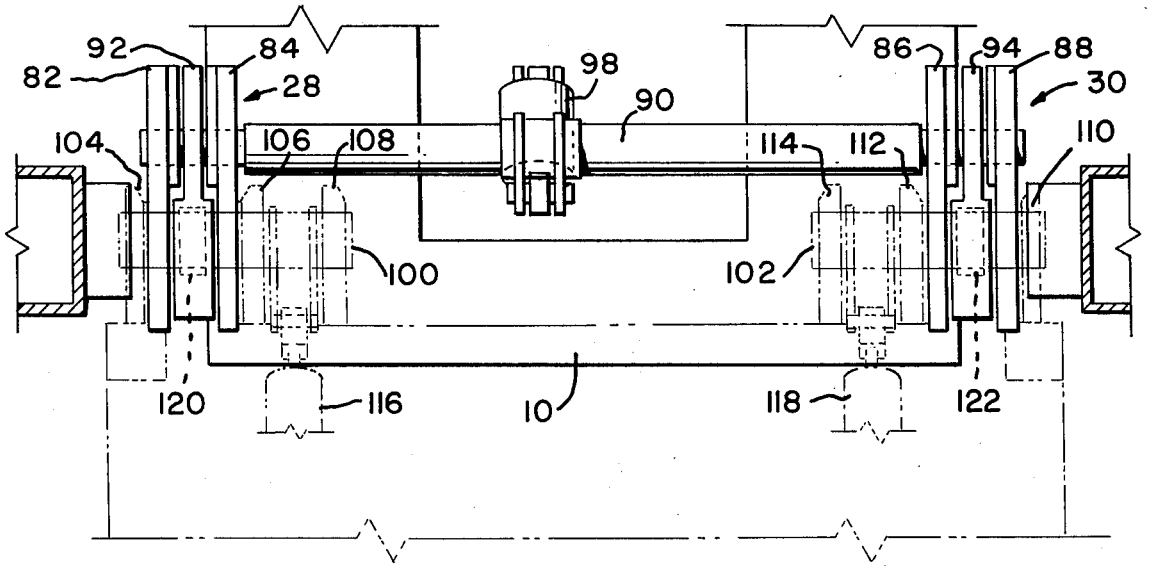
FIG. 6 is a top view of the lower pivot section.

Referring specifically to FIGS. 4, 6, and 7 the lower pivot means 28 includes a first pair of clevises 82 and 84 and a second pair of laterally spaced clevises 86 and 88 mounted on platform 10 (see FIG. 6). A rotatable shaft 90 has its one end supported by clevises 82 and 84 and its other end supported bu clevises 86 and 88. A first hook 92 is mounted between clevises 82 and 84 and a second hook 94 is mounted between clevises 86 and 88. The hooks 92 and 94 are rotated by rotation of shaft 90. Shaft 90 is rotated by hydraulic rod 96 extending from hydraulic cylinder 98.

A pair of laterally separated rotatable shafts 100 and 102 are mounted on shaft supports 104, 106, and 108 for rotatable shaft 100, and shaft supports 110, 112 and 114 for rotatable shaft 102. Rotatable shafts 100 and 102 are actuated by hydraulic rods extending from hydraulic cylinders 116 and 118, respectively.

Rotatable shaft 100 is provided with a hook locking ear 120 (see FIG. 6) adapted to lock hook 92 and rotatable shaft 102 is provided with hook locking ear 122 adapted to lock hook 94. Hooks 92 and 94 are provided with undercuts shaped with respect to the locking ears 120 and 122 such that when the drill tower is moved horizontal horizonal to vertical, and the rotatable shafts 100 and 102 have been moved into the clevises the hooks 92 and 94 can be actuated by cylinder 98 through shaft 90, while simultaneously the rotatable shaft 100 and 102 are actuated by cylinders 116 and 118, respectively, to turn the shafts 100 and 102 to a position such that the hooks 92 and 94 are positively locked to the shafts 100 and 102 by the locking ears 120 and 122, respectively.

In operation the drill tower 12 is moved on the mobile platform 10 from one drill site to another drill site in the horizontal position, as shown in FIG. 1 and FIG. 4. The locking ears, 58, 60, 62, and 64 on shaft 44 are in position so that the shaft 44, connected to the drill tower 12 cannot be moved out of the supports 14 and 16 through the slots 42. Also, the hook locking ears 70 and 72 are in position so that it is impossible to remove the hooks 66 and 68 from around the shaft 44. Thus, the shaft is positively locked in position on the support and the hooks are positively locked in position on the shaft.

When the mobile platform 10 has arrived at the new drilling location, the hydraulic cylinder 24 is actuated to extend the hydraulic rod 22 to thereby pivot the drill tower 12 about the top pivots from the horizontal to the vertical position shown in FIG. 2 and by the broken lines of FIG. 4. With this 90° movement of the drill tower the shaft 44 rotates 90° counterclockwise looking at FIG. 4 and FIG. 7 to a position where the shaft 44 may be moved from the supports 14 and 16 through the slots. However, shaft 44 cannot be moved from the supports through the slots until the hooks 66 and 68 are actuated. The hooks are not actuated until after the shafts 100 and 102 connected to the bottom of the drill tower 12 are securely locked in the bottom pivot means 28 and 30, respectively. Therefore, during the movement of the drill tower from the horizontal to the vertical, the shaft 44 is kept firmly locked in position in the supports 14 and 16.

When the drill tower 12 is in the verticl position with the rotatable shaft 100 and 102 located in the clevises 82, 84 and 86, 88 on the platform 10, the cylinders 98, 116, and 118 are hydraulically sequenced to actuate cylinder 98 first and then 116 and 118 simultaneously, thus positoning hooks 92 and 94 over rotatable shafts 100 and 102 and then rotating shafts 100 and 102 to a position whereby locking ears 120 and 122 are engaged into hooks 92 and 94 respectively, positively locking shafts 100 and 102.

For angle drilling the drill tower 12 is pivoted about the lower pivots to the desired angle of say 30° such as shown in FIG. 3 and the broken lines of FIG. 7. This is accomplished by actuating the cylinder 24 to move rod 22 inwardly until the tower is in the position shown in FIG. 3. The tower 12 is locked in position by actuating the hydraulic cylinder 40 (see FIG. 3) to move the pneumatic rod 38 into the proper hole (not shown) contained in the shaft 32.

We claim:

1. Drilling apparatus comprising: a platform; a pair of laterally separated supports extending upwardly from the platform, each having a shaft receiving bore and a slot extending from the shaft receiving bore; a drill tower having shaft means adapted to slide into the slots for pivotally connecting the drill tower to the supports; positively locking means including a pair of diametric locking ears on the shaft means adapted to positively lock the shaft means in said slots when the drill tower is horizontal and adapted to permit the shaft means to slide from the supports after the drill tower is moved to the vertical position; means for pivoting the drill tower about the first pivot means; a second pivot means including slotted means mounted on the platform and a second part of the drill tower adapted to fit into the slotted means; means for positively locking said second part of the drill tower to the platform; and means for pivoting the drill tower about the second pivot means, whereby the drill tower may be pivoted from the horizontal position to the vertical position, positively locked to the second pivot means, disconnected from the first pivot means and pivoted about the second pivot means.

2. A drill apparatus comprising: a platform; first pivot means including drill tower support means extending upwardly from the platform and including a pair of laterally separated supports, each having a shaft receiving bore and a slot extending from the shaft receiving bore, a drill tower having shaft means adapted to slide into the slots for pivotally connecting the drill tower to the supports, positive locking means including a pair of diametric locking ears on the shaft means adapted to positively lock the shaft means in the supports when the drill tower is horizontal and adapted to permit the shaft means to slide from the supports after the drill tower is pivoted to the verticl position; a hook assembly having an undercut, the shaft means having a third locking ear longitudinally spaced from the other two locking ears and circumferentially located between the other two locking ears, the third locking ear being adapted to have an interference fit with the walls of the undercut when the drill tower is in the horizontal position so that the hook is positively locked to the shaft means, the third locking ear being adapted to move to a position within the undercut when the drill tower is in the vertical position to permit the hook to be removed from the shaft means; a second pivot means including slotted means mounted on the platform and a second part of the drill tower adapted to fit into the slotted means; means for positively locking said second part of the drill tower to the platform; and means for pivoting the drill tower about the second pivot means, whereby the drill tower may be pivoted from the horizontal position to the vertical position, positively locked to the second pivot means, disconnected from the first pivot means and pivoted about the second pivot means.

3. A drilling apparatus in accordance with Claim 2 wherein: the slotted means mounted on the platform are a pair of laterally separated clevises, a pair of laterally separated rotatable shaft are mounted on the drill tower; a pair of laterally separated hooks are mounted on the platform and each having an undercut; and each rotatable shaft is provided with a locking ear adapted to fit into the undercut of the corresponding hook and adapted to positively lock the drill tower to the platform.

* * * * *